US007917357B2

(12) United States Patent
Florencio et al.

(10) Patent No.: US 7,917,357 B2
(45) Date of Patent: Mar. 29, 2011

(54) REAL-TIME DETECTION AND PRESERVATION OF SPEECH ONSET IN A SIGNAL

(75) Inventors: Dinei Florencio, Redmond, WA (US); Philip A. Chou, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 190 days.

(21) Appl. No.: 12/181,159

(22) Filed: Jul. 28, 2008

(65) Prior Publication Data

US 2008/0281586 A1 Nov. 13, 2008

Related U.S. Application Data

(62) Division of application No. 10/660,326, filed on Sep. 10, 2003, now Pat. No. 7,412,376.

(51) Int. Cl.
*G10L 11/02* (2006.01)
*G10L 21/04* (2006.01)

(52) U.S. Cl. ..... 704/215; 704/503; 370/470; 370/521

(58) Field of Classification Search ..... 704/201, 704/207, 210, 215, 503, 504; 370/521, 545, 370/470

See application file for complete search history.

(56) References Cited

U.S. PATENT DOCUMENTS

| | | | | | |
|---|---|---|---|---|---|
| 4,153,816 | A * | 5/1979 | Morgan | ..... | 370/435 |
| 4,696,039 | A * | 9/1987 | Doddington | ..... | 704/215 |
| 4,890,325 | A * | 12/1989 | Taniguchi et al. | ..... | 704/208 |
| 5,611,018 | A * | 3/1997 | Tanaka et al. | ..... | 704/215 |
| 5,617,508 | A * | 4/1997 | Reaves | ..... | 704/233 |
| 5,751,903 | A * | 5/1998 | Swaminathan et al. | ..... | 704/230 |
| 5,809,454 | A * | 9/1998 | Okada et al. | ..... | 704/214 |
| 5,884,257 | A * | 3/1999 | Maekawa et al. | ..... | 704/248 |
| 5,953,695 | A * | 9/1999 | Barazesh et al. | ..... | 704/201 |
| 6,324,188 | B1 * | 11/2001 | Tsuji | ..... | 370/537 |
| 6,535,844 | B1 * | 3/2003 | Wood et al. | ..... | 704/210 |
| 6,799,161 | B2 * | 9/2004 | Yokoyama | ..... | 704/226 |
| 6,865,162 | B1 * | 3/2005 | Clemm | ..... | 370/286 |
| 6,885,987 | B2 * | 4/2005 | Buchholz et al. | ..... | 704/228 |
| 7,031,916 | B2 * | 4/2006 | Li et al. | ..... | 704/233 |
| 7,130,797 | B2 * | 10/2006 | Beaucoup et al. | ..... | 704/233 |
| 7,162,418 | B2 * | 1/2007 | Leichtling et al. | ..... | 704/215 |
| 7,337,108 | B2 * | 2/2008 | Florencio et al. | ..... | 704/208 |
| 7,412,376 | B2 * | 8/2008 | Florencio et al. | ..... | 704/206 |
| 7,505,594 | B2 * | 3/2009 | Mauro | ..... | 380/261 |
| 7,596,488 | B2 * | 9/2009 | Florencio et al. | ..... | 704/208 |
| 2003/0101049 | A1 * | 5/2003 | Lakaniemi et al. | ..... | 704/214 |

* cited by examiner

*Primary Examiner* — Martin Lerner

(74) *Attorney, Agent, or Firm* — Lyon & Harr, LLP; Mark A. Watson

(57) ABSTRACT

A "speech onset detector" provides a variable length frame buffer in combination with either variable transmission rate or temporal speech compression for buffered signal frames. The variable length buffer buffers frames that are not clearly identified as either speech or non-speech frames during an initial analysis. Buffering of signal frames continues until a current frame is identified as either speech or non-speech. If the current frame is identified as non-speech, buffered frames are encoded as non-speech frames. However, if the current frame is identified as a speech frame, buffered frames are searched for the actual onset point of the speech. Once that onset point is identified, the signal is either transmitted in a burst, or a time-scale modification of the buffered signal is applied for compressing buffered frames beginning with the frame in which onset point is detected. The compressed frames are then encoded as one or more speech frames.

20 Claims, 5 Drawing Sheets

REAL-TIME DETECTION AND PRESERVATION OF SPEECH ONSET IN A SIGNAL

CROSS REFERENCE TO RELATED APPLICATIONS

This application is a Divisional Application of U.S. patent application Ser. No. 10/660,326, filed on Sep. 10, 2003, now U.S. Pat. No. 7,412,376, issued Aug. 12, 2008, by Florencio, et al., and entitled "A SYSTEM AND METHOD FOR REAL-TIME DETECTION AND PRESERVATION OF SPEECH ONSET IN A SIGNAL," and claims the benefit of that prior application under Title 35, U.S. Code, Section 120.

BACKGROUND

1. Technical Field

The invention is related to automatically determining when speech begins in a signal such as an audio signal, and in particular, to a system and method for accurately detecting speech onset in a signal by examining multiple signal frames in combination with signal time compression for delaying a speech onset decision without increasing average signal delay.

2. Related Art

The detection of the boundaries or endpoints of speech in a signal, such as an audio signal, is useful for a large number of conventional speech related applications. For example, a few such applications include encoding and transmission of speech, speech recognition, and speech analysis. In most of these schemes, it is desirable to process speech in as close to real-time as possible, or using as little non-speech components of the signal as possible so as to minimize computational overhead. In fact, for most such conventional systems, both inaccurate speech endpoint detection and inclusion of non-speech components of the signal have an adverse effect on overall system performance.

There are a large variety of schemes for detecting speech endpoints in a signal. For example, one scheme commonly used for detecting speech endpoints in a signal is to use short-time or spectral energy components of the signal to identify speech within that signal. Often, an adaptive threshold based on features of an energy profile of the signal is used to discriminate between speech and background noise in the signal. Unfortunately, such schemes tend to cut off the ends of words in both noisy and quiet environments. Other endpoint detection schemes include examining signal entropy, using neural networks to examine the signal for extracting speech from background noise, etc.

As noted above, the detection of speech endpoints in a signal is central to a number of applications. Clearly, identifying the endpoints of speech in the signal requires an identification of both the onset and the termination of speech within that signal. Typically, analysis of several signal frames may be required to reliably detect speech onset and termination in the signal, even in a relatively noise free signal.

Further, many conventional speech detection schemes continue to encode signal frames as speech for a few frames after relative silence is first detected in the signal. In this manner, the end point or termination of speech in the signal is usually captured by the speech detection scheme at the cost of simply encoding a few extra signal frames. Unfortunately, since it is unknown when speech will begin in a real-time signal, performing a similar operation for capturing speech onset typically presents a more complex problem.

In particular, some schemes address the onset detection problem by simply buffering a number of signal frames until speech onset is detected in the signal. At that point, these schemes then encode the signal beginning with a number of the buffered frames so as to more reliably capture actual speech onset in the signal. Unfortunately, one of the problems with such schemes is that transmission or processing of the signal is typically delayed by the length of the signal buffer, thereby increasing overall signal delay or computational overhead. Attempts to address the average signal delay typically involve reducing buffer size in combination with better speech detection algorithms. However, the delay due to the use of a buffer still exists. Some schemes have attempted to address this problem by simply eliminating the buffer entirely, or by using a very small signal buffer. However, as a result, these schemes frequently chop off some small portion of the beginning of the speech in the signal. As a result, audible artifacts are often produced in the decoded signal.

Therefore, what is needed is a system and method that provides for robust and accurate speech onset detection in a signal while minimizing average signal delay resulting from the use of a signal frame buffer.

SUMMARY

The detection of the presence of speech embedded in various types of non-speech events and background noise in a signal is typically referred to as speech endpoint detection, speech onset detection, or voice onset detection. In general, the purpose of endpoint detection is simply to distinguish speech and non-speech segments within a digital speech signal. Common uses for speech endpoint detection include automatic speech recognition, assignment of communication channels based on speech activity detection, speaker verification, echo cancellation, speech coding, real-time communications, and many other applications. Note that throughout this description, the use of the term "speech" is generally intended to indicate speech such as words, or other non-word type utterances.

Conventional methods for identifying speech endpoints typically involve a frame-based analysis of the signal, with typical frame length being on the order of about 10 ms for determining whether particular signal frames include speech or other utterances. These conventional methods are typically based on any of a number of functions, including, for example, functions of signal short-time energy, pitch detection, zero-crossing rate, spectral energy, periodicity measures, signal entropy information, etc. Accurate determination of speech endpoints, relative to silence or background noise, serves to increase overall system accuracy and efficiency. Furthermore, to increase the robustness of the classification, a conventional method may buffer a fixed number of samples or frames. These extra samples are used to aid in the classification of the preceding frame. Unfortunately, while it increases the reliability of the classification, such buffering introduces an additional delay.

A "speech onset detector," as described herein, builds on conventional frame-based speech endpoint detection methods by providing a variable length frame buffer. In general, frames which can be clearly identified as speech or non-speech are classified right away, and encoded as appropriate. The variable length frame buffer is used for buffering frames that can not be clearly identified as either speech or non-speech frames during the initial analysis. It should be noted that such frames are referred to throughout this description as "not sure" frames. Buffering of the signal frames then continues either until a decision about those frames can be made, or until such time as a current frame is identified as either speech or non-speech. At this point, a retroactive decision about the "not sure" frames is made, and the not-sure frames are encoded as either speech or silence frames, as appropriate. In addition, as described below, in one embodiment, the speech onset detector is also used in combination with temporal compression of the buffered frames.

In particular, in one embodiment, as soon as the current frame is identified as non-speech, then both the buffered not sure frames and the current frame are encoded as silence, or non-speech, signal frames. However, if the current frame is instead identified as a speech frame, then the speech onset detector begins a time-scale modification of both the buffered not sure frames and the current frame for temporally compressing those frames. The temporally compressed frames are then encoded as some lesser total number of frames, with the number of encoded frames depending upon the amount of temporal compression. Further, in one embodiment, the amount of temporal compression applied to the frames is proportional to the number of frames in the buffer. Consequently, as the size of the buffer increases, the compression applied to those frames will increase so as to minimize the average signal delay and the effective average bitrate.

It should be noted that temporal compression of audio signals such as speech is well known to those skilled in the art, and will not be discussed in detail herein. However, those skilled in the art will appreciate that many conventional audio temporal compression methods operate to preserve signal pitch while reducing or eliminating signal artifacts that might otherwise result from such temporal compression.

In a related embodiment, if the current frame is identified as a speech frame, then the speech onset detector searches the buffered not sure frames to locate the actual starting point, or onset, of the speech identified in the current frame. This search proceeds by using the detected speech in the current frame to initialize the search of the buffered frames. As is well known to those skilled in the art, given an audio signal, it is often easier to identify the actual starting point of some component of that signal given a sample from within that component. For example, it is often easier to find the beginning of a spoken word or other utterance in a signal by working backwards from a point within that utterance to find the beginning of the utterance. Once that onset point has been identified, then the speech onset detector begins a time-scale modification of the buffered signal for compressing the buffered frames beginning with the frame in which the onset point is detected. The compressed buffered signal is then encoded as one or more speech frames as described above. One advantage of this embodiment is that it typically results in encoding even fewer "speech" frames than does the previous embodiment wherein all buffered frames are encoded when a speech frame is identified.

In another embodiment, applicable in situations where the receiver does not expect frames at regular intervals, the variable length buffer is encoded whenever a decision about the classification is made, but without need to time-compress the buffer. In this case, the next packet of information may contain information pertaining to more than one frame. At the receiver side, these extra frames are used to either increase the local buffer, or, in one embodiment, the receiver itself uses time compression to reduce the delay.

Another advantage of the speech onset detector described herein over existing speech endpoint detection methods is provided by the variable buffer length of the speech onset detector in combination with speech compression of buffered speech frames. In particular, given a variable length frame buffer, in some cases no frames will need to be buffered if speech or non-speech is detected in the current frame with sufficient reliability. As a result, any signal delay or bitrate increase that would otherwise result from use of a buffered signal is minimized or eliminated. Further, because at least a portion of the buffered signal is compressed, the effects of the use of a signal buffer are again minimized. In other words, the speech onset detector serves to preserve speech onset in a signal while minimizing any signal transmission delay.

In view of the above summary, it is clear that the speech onset detector provides a unique system and method for real-time detection and preservation of speech onset. In addition to the just described benefits, other advantages of the system and method for real-time detection and preservation of speech onset will become apparent from the detailed description which follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
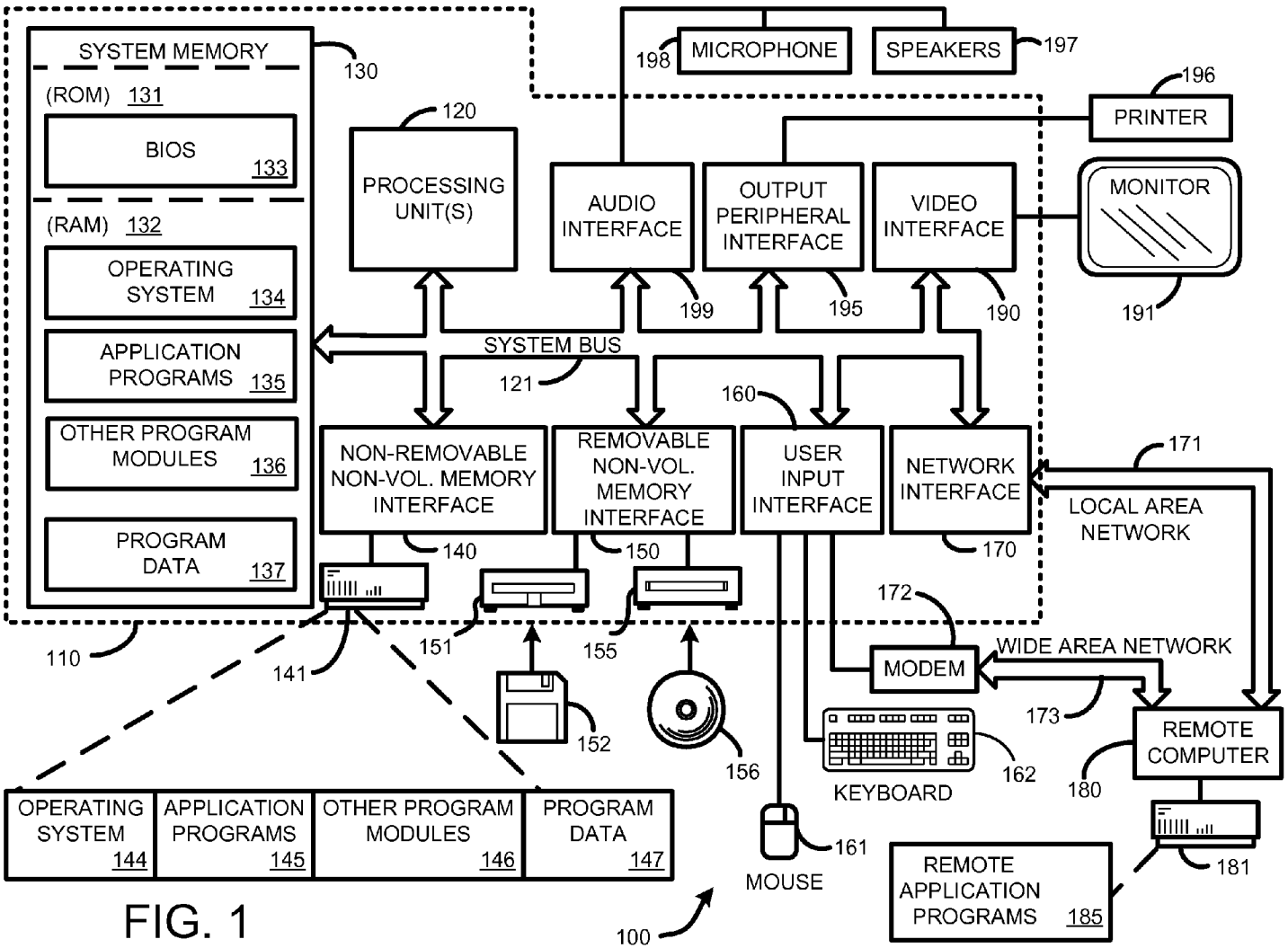
FIG. 1 is a general system diagram depicting a general-purpose computing device constituting an exemplary system for real-time detection and preservation of speech onset.

1.0 Exemplary Operating Environment:

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, digital telephones, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

In addition, the computer 110 may also include a speech input device, such as a microphone 198 or a microphone array, as well as a loudspeaker 197 or other sound output device connected via an audio interface 199. Other input devices (not shown) may include a joystick, game pad, satellite dish, scanner, radio receiver, and a television or broadcast video receiver, or the like. These and other input devices are often connected to the processing unit 120 through a user input interface 160 that is coupled to the system bus 121, but may be connected by other interface and bus structures, such as, for example, a parallel port, game port, or a universal serial bus (USB). A monitor 191 or other type of display device is also connected to the system bus 121 via an interface, such as a video interface 190. In addition to the monitor, computers may also include other peripheral output devices such as printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the program modules and processes embodying a "speech onset detector" for identifying and encoding speech onset in a digital audio signal.

2.0 Introduction:

The detection of the presence of speech embedded in various types of non-speech events and background noise in a signal is typically referred to as speech endpoint detection, speech onset detection, or voice onset detection. In general, the purpose of endpoint detection is simply to distinguish speech and non-speech segments within a digital speech signal. Common uses for speech endpoint detection include automatic speech recognition, assignment of communication channels based on speech activity detection, speaker verification, echo cancellation, speech coding, real-time communications, and many other applications. Note that throughout this description, the use of the term "speech" is generally intended to indicate speech such as words, as well as other non-word type utterances.

Conventional methods for identifying speech endpoints typically involve a frame-based analysis of the signal, with typical frame length being on the order of about 10 ms. These conventional methods are typically based on any of a number of functions, including, for example, functions of signal short-time energy, pitch detection, zero-crossing rate, spectral energy, periodicity measures, signal entropy information, etc. Accurate determination of speech endpoints, relative to silence or background noise, serves to increase overall system accuracy and efficiency.

With most such systems, bandwidth is typically a limiting factor when transmitting speech over a digital channel. A number of conventional systems attempt to limit the effect of bandwidth limitations on a transmitted signal by reducing an average effective transmission bitrate. With speech, the effective average bitrate is often reduced by using a speech detector for classifying signal frames as either "silence" or as speech through a process of speech endpoint detection. A reduction in the effective average bitrate is then achieved by simply not encoding and transmitting those frames that are determined to be "silence" (or some noise other than speech).

For example, one simple conventional frame-based system for transmitting a digital speech signal begins by analyzing a first signal frame to determine whether it is speech. Typically, a speech activity detector (SAD) or the like is used in making this determination. If the SAD determines that the current frame is not speech, i.e., it is either background noise of some sort or even actual silence, then the current frame is simply skipped, or encoded as a "silence" frame. However, if the SAD determines that the current frame is speech, then that frame is encoded and transmitted using conventional encoding and transmission protocols. This process then continues for each frame in the signal until the entire signal has been processed.

In theory, such a system should be capable of operating in near real-time, as analysis of a particular signal frame should take less than the temporal length of that frame. Unfortunately, conventional SAD processing techniques are incapable of perfect speech detection. Therefore, the start and end of many speech utterances in a signal containing speech are often chopped off or truncated. Typically, many SAD systems address this issue by balancing system sensitivity as a function of speech detection "false negatives" and "false positives." For example, as speech detection sensitivity decreases, the number of false positive identifications made (e.g., identification of a silence frame as a speech frame) will decrease. Conversely, as the sensitivity of the speech detection increases, the number of false negative identifications made (e.g., identification of a speech frame as a silence frame) will increase. False positives tend to increase the bit rate necessary to transmit the signal, because more frames are determined to be speech frames, and thus must be encoded and transmitted. Conversely, false negatives effectively truncate parts of the speech signals, thereby degrading the perceived quality, but reducing the bit rate necessary to transmit the remaining speech frames of the signal.

To address the problem of false negatives at the tail end of detected speech, one solution employed by many conventional SAD schemes is to simply transmit a few extra signal frames following the end of the detected speech to avoid prematurely truncating the tail end of any words or utterances in the transmitted speech signal. However, this simple solution does nothing to address false negatives at the beginning of any speech in a signal. However, a number of schemes successfully address this problem by using a frame buffer of some predetermined length for buffering a number of signal samples or frames. These extra samples (or frames) in the buffer are then used to help decide on the presence of speech in the oldest frame in the buffer.

For example, a decision on a frame having 320 samples may be based on a window involving 960 samples, where 320 of the additional samples are from a previous frame (i.e., the signal before the current frame) and 320 from the next frame (i.e., the signal after the current frame). Then, if speech is detected in the "current" frame, encoding and transmission of that frame begins with that frame, even though a "next frame" is already in the buffer. As a result, fewer actual speech frames are lost at the beginning of any utterance in a speech signal. However, because extra frames are used in the classification process, the average signal delay increases by a constant factor. The increase in delay is in direct proportion to the size of the buffer (in this example by 320 samples).

Additionally, note that in traditional voice communications, the encoder and decoder need to be "in sync." For this reason, a "frame rate" is traditionally pre-set and constant during the communication process. For example, 20 ms is a common choice. In this scenario, the encoder encodes and transmits speech at regular time intervals of 20 ms. In several other communications systems, there is some flexibility in this timing. For example, in the Internet, packets may have a variable transmission delay. Therefore, even if packets leave the transmitter at regular intervals, they are not likely to arrive at the receiver at regular intervals. In these cases, it is not as important to have the packets leave the transmitter at regular intervals.

2.1 System Overview:

A "speech onset detector," as described herein, builds on the aforementioned conventional frame-based speech endpoint detection methods by providing a variable length frame buffer for use in making delayed retroactive decisions about frame or segment type of an audio signal. In general, frames or segments which can be clearly identified as speech or non-speech are classified right away, and encoded using an encoder designed specifically for the particularly identified frame type, as appropriate. In addition, the variable length frame buffer is used for buffering frames that can not be clearly identified as either speech or non-speech frames during the initial analysis. It should be noted that such frames are referred to throughout this description as "not sure" frames or "unknown type" frames. Buffering of the signal frames then continues either until a decision about those frames can be made, or until such time as a current frame is identified as either speech or non-speech. At this point, a retroactive decision about the "not sure" frames is made, and the not-sure frames are encoded as either speech or silence frames, as appropriate, by identifying one or more of the not sure frames as having the same type as the current frame.

One embodiment of the speech onset detector considers the fact that in some applications, signal packets do not have to leave the encoder at regular intervals. In this embodiment, the input signal is buffered for as long as necessary to make a reliable decision about speech presence in the buffered frames. As soon as a decision is made (often about several frames at one time) all of the buffered segments are encoded and transmitted at once as a burst-type transmission. Note that some encoding methods actually merge all the frames into a single, longer, frame. This longer frame can then be used to increase the compression efficiency. Further, even if a fixed-frame encoding algorithm is being used, all frames currently in the buffer are encoded and sent immediately (i.e., without concern for the "frame-rate"). These frames will then be buffered at a receiver.

Further, in one embodiment, if the receiver is operating on a traditional fixed-frame mode, the extra data in the buffer will help smooth eventual fluctuations in the transmission delay (i.e., delay jitter). For example, one embodiment of the speech onset detector with burst transmission is used in combination with a method for jitter control as described in a copending United States utility patent application entitled "A SYSTEM AND METHOD FOR REAL-TIME JITTER CONTROL AND PACKET-LOSS CONCEALMENT IN AN AUDIO SIGNAL," now application Ser. No. 10/663,390 filed 15 Sep. 2003, the subject matter of which is hereby incorporated herein by this reference.

In general, as described in the aforementioned copending patent application entitled "A SYSTEM AND METHOD FOR REAL-TIME JITTER CONTROL AND PACKET-LOSS CONCEALMENT IN AN AUDIO SIGNAL," an "adaptive audio playback controller" operates by decoding and reading received packets of an audio signal into a frame buffer. Samples of the decoded audio signal are then played out of the frame buffer according to the needs of a player device. Jitter control and packet loss concealment are accomplished by continuously analyzing buffer content in real-time, and determining whether to provide unmodified playback from the buffer contents, whether to compress buffer content, stretch buffer content, or whether to provide for packet loss concealment for overly delayed or lost packets as a function of buffer content. Further, the adaptive audio playback controller also determines where to stretch or compress particular frames or signal segments in the frame buffer, and how much to stretch or compress such segments in order to optimize perceived playback quality.

As noted above, in one embodiment, as soon as the current frame is identified as non-speech, then both the buffered not sure frames and the current frame are either encoded as silence, or non-speech, signal frames, or simply skipped. However, in a related embodiment, once the actual type not sure frames has been identified, the speech onset detector begins a time-scale modification of both the buffered not sure frames and the current frame for temporally compressing those frames. The temporally compressed frames are then encoded as some lesser total number of frames prior to transmission, with the number of encoded frames depending upon the amount of temporal compression applied. Further, in a related embodiment, the amount of temporal compression applied to the frames is proportional to the number of frames in the buffer. Consequently, as the size of the buffer increases, the compression applied to those frames will increase so as to minimize the average signal delay and the effective average bitrate.

It should be noted that temporal compression of audio signals such as speech, on the transmitter side (prior to transmission), is well known to those skilled in the art, and will not be discussed in detail herein. Those skilled in the art will appreciate that many conventional audio temporal compression methods operate to preserve signal pitch while reducing or eliminating signal artifacts that might otherwise result from such temporal compression.

Further, in one embodiment described with respect to the receiver side of a communications system, if the receiver is operating in a variable payout schedule, then it dynamically adjusts the delay by compressing or stretching the data in the receiver buffer, as necessary. In particular, this embodiment is described in a copending United States utility patent application entitled "A SYSTEM AND METHOD FOR PROVIDING HIGH-QUALITY STRETCHING AND COMPRESSION OF A DIGITAL AUDIO SIGNAL," now application Ser. No. 10/660,325 filed Sep. 10, 2003, the subject matter of which is hereby incorporated herein by this reference.

In general, as described in the aforementioned copending patent application entitled "A SYSTEM AND METHOD FOR PROVIDING HIGH-QUALITY STRETCHING AND COMPRESSION OF A DIGITAL AUDIO SIGNAL," a novel stretching and compression method is described for providing an adaptive "temporal audio scalar" for automatically stretching and compressing frames of audio signals received across a packet-based network. Prior to stretching or compressing segments of a current frame, the temporal audio scalar first computes a pitch period for each frame for sizing signal templates used for matching operations in stretching and compressing segments.

Further, the temporal audio scalar also determines the type or types of segments comprising each frame. These segment types include "voiced" segments, "unvoiced" segments, and "mixed" segments which include both voiced and unvoiced portions. The stretching or compression methods applied to segments of each frame are then dependent upon the type of segments comprising each frame. Further, the amount of stretching and compression applied to particular segments is automatically variable for minimizing signal artifacts while still ensuring that an overall target stretching or compression ratio is maintained for each frame.

In yet another embodiment, if the current frame is identified as a speech frame, the speech onset detector then searches the buffered not sure frames to locate the actual starting point, or onset, of the speech identified in the current frame. This search proceeds by using the detected speech in the current frame to initialize the search of the buffered frames. As is well known to those skilled in the art, given an audio signal, it is often easier to identify the actual starting point of some component of that signal given a sample from within that component.

For example, it is often easier to find the beginning of a spoken word or other utterance in a signal by working backwards from a point within that utterance to find the beginning of the utterance. Once that onset point has been identified, then the speech onset detector begins a time-scale modification of the buffered signal for compressing the buffered frames beginning with the frame in which the onset point is detected. The compressed buffered signal is then encoded as one or more speech frames as described above. One advantage of this embodiment is that it typically results in encoding even fewer "speech" frames than does the previous embodiment wherein all buffered frames are encoded when a speech frame is identified.

Another advantage of the speech onset detector described herein over existing speech endpoint detection methods is provided by the variable buffer length of the speech onset detector in combination with speech compression of buffered speech frames. In particular, given a variable length frame buffer, in some cases no frames will need to be buffered if speech or non-speech is detected in the current frame with sufficient reliability. As a result, any signal delay or bitrate increase that would otherwise result from use of a buffered signal is minimized or eliminated. Further, because at least a portion of the buffered signal is compressed, the effects of the use of a signal buffer are again minimized. In other words, the speech onset detector serves to preserve speech onset in a signal while minimizing any signal transmission delay.

Consequently, the speech onset detector is advantageous for use in encoding a digital communications signal, such as, for example, a digital or digitized telephone signal, or other real-time communications device in which minimization of signal delay and average transmission bandwidth is desirable.

Figure 2:
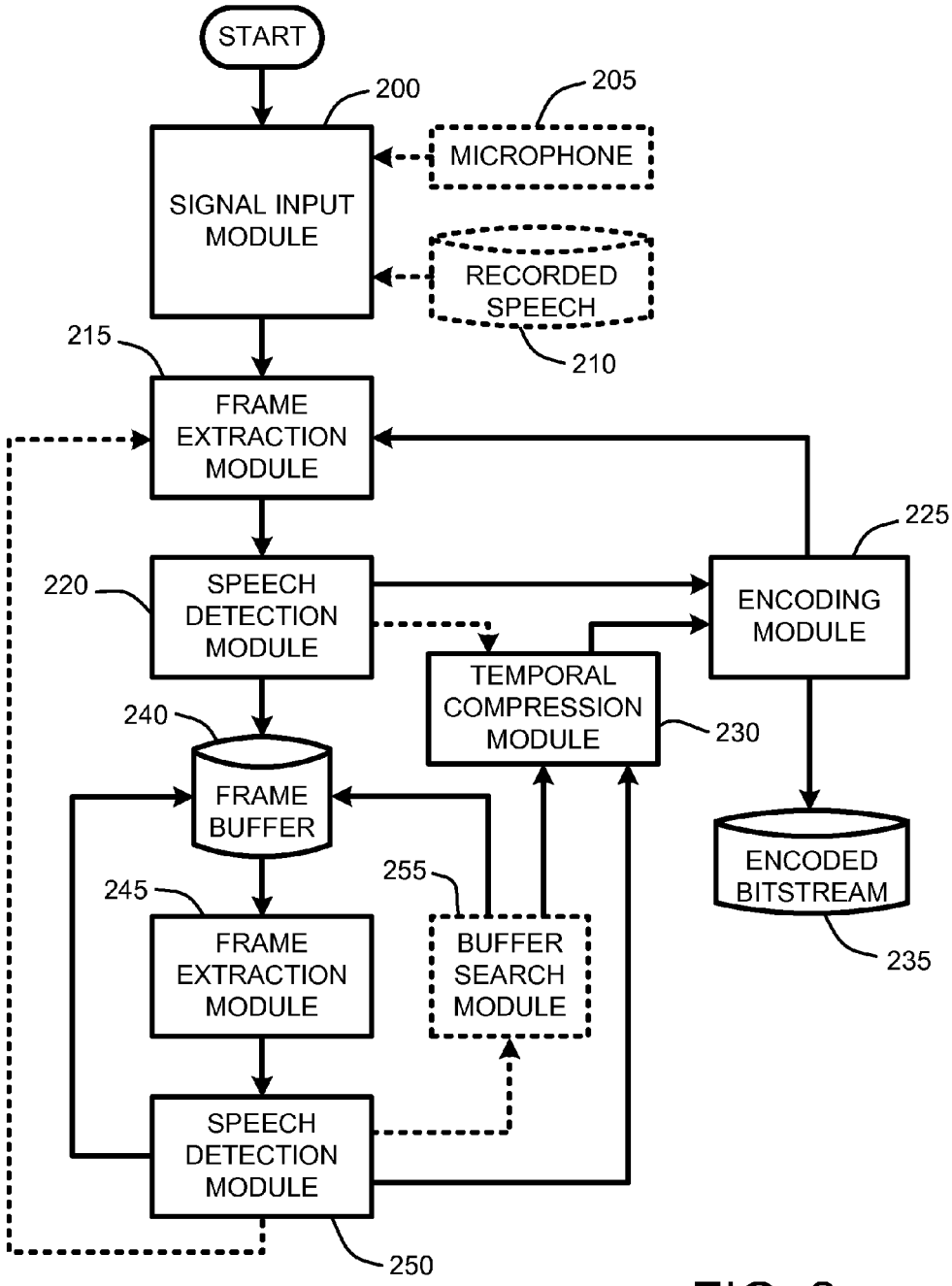
FIG. 2 illustrates an exemplary architectural diagram showing exemplary program modules for real-time detection and preservation of speech onset.

2.2 System Architecture:

The processes summarized above are illustrated by the general system diagram of FIG. 2. In particular, the system diagram of FIG. 2 illustrates the interrelationships between program modules for implementing a speech onset detector for providing real-time detection and preservation of speech onset. It should be noted that the boxes and interconnections between boxes that are represented by broken or dashed lines in FIG. 2 represent alternate embodiments of the speech onset detector described herein, and that any or all of these alternate embodiments, as described below, may be used in combination with other alternate embodiments that are described throughout this document.

In particular, as illustrated by FIG. 2, a system and method for real-time detection and preservation of speech onset begins by using a signal input module 200 for inputting a digitized audio signal containing speech or other utterances. The input to the signal input module 200 is provided by either a microphone 205, such as the microphone in a telephone or other communication device, or is provided as a pre-recorded or computer generated sample of a signal containing speech 210. In either case, the signal input module 200 then provides the digitized audio signal to a frame extraction module 215 for extracting sequential signal frames from the input signal. Typically, frames lengths on the order of about 10 ms or longer have been found to provide good results when detecting speech onset in a signal.

The frame extraction module 215 extracts a current signal frame from the input signal and provides that current signal frame to a speech detection module 220 which uses any of a number of well known conventional techniques for detecting the onset of speech in the signal frame. In particular, the speech detection module 220 attempts to make a determination of whether the current frame is a "speech" frame or a "silence" frame. Note that a number of conventional techniques require an initial sampling of a number of signal frames to establish a baseline or background for identifying speech within a signal. Regardless of whether an initial sampling is required, once the speech detection module 220 conclusively determines that the current signal is either a speech frame or a silence frame, then that current signal frame is provided to an encoding module 225 that uses conventional encoding techniques for encoding a signal bitstream 235.

In one embodiment, as soon as a decision about a frame or a group of frames is made, the frame (or the whole group of frames) is encoded and transmitted, without regard to any pre-established "frame interval." The encoder will receive these frames and either use them to fill its own buffer, or use time compression, as described above, at the decoder side. Note that by transmitting the data as soon as possible after the voice/silence decision effectively reduces the delay by providing an initial burst of data that will help fill the decoder buffer, allowing the receiver to keep a smaller delay. This is in contrast to conventional techniques where the encoder only sends information at a regular, pre-defined interval.

Note that in one embodiment, a temporal compression module 230 is also provided for providing a time-scale modification of the current frame for temporally compressing that frame prior to encoding of that frame. The decision as to whether the current frame is to be temporally compressed is made as a function of how close to real-time the current frame is. For example, if encoding and transmission of the current frame is occurring in real-time, then there is no need to temporally compress that frame. However, if encoding and transmission of the signal has been delayed, or is not sufficiently close to real-time, then temporal compression of the current frame serves to decrease any gap between the current signal frame and real-time encoding and transmission of the signal. As noted above, temporal compression of audio signals such as speech is well known to those skilled in the art, and will not be discussed in detail herein.

In the case where the speech detection module 220 is unable to conclusively determine whether the current frame is either a speech frame or a silence frame, the current frame is labeled as a "not-sure" frame, and is provided to a frame buffer 240 for temporary storage. A second frame extraction module 245 (identical to the first frame extraction module 215) then extracts a new current signal frame from the input signal. A second speech detection module 250 (identical to the first speech detection module 220) then analyses that current signal frame, again using conventional techniques, for determining whether that signal frame is a speech frame, a silence frame, or a not-sure frame, as described above.

When the current signal frame is a not-sure frame, i.e., it cannot be conclusively identified as a speech frame or as a silence frame, then that current frame is added to the frame buffer 240. The frame extraction module 245 then extracts a new current signal frame from the input signal, followed by a frame type determination by the speech detection module 250. This loop (frame extraction, frame analysis, and frame buffering) continues until the current frame provided by the frame extraction module 250 is determined by the speech detection module 250 to be either a speech frame or a silence frame. At this point, the frame buffer 240 will include at least one signal frame.

Next, if the current frame is determined to be a silence frame, then all of the frames in the frame buffer 240 are also identified as silence frames. These silence frames, including the current frame, are then either discarded, or encoded as a temporally compressed period of silence by the encoding module 225, and included in the encoded bitstream 235. Note that in one embodiment, when encoding silence in the signal, temporal compression of the period of silence representing the silence frames is accomplished by simply overlapping and adding the signal frames to any extent desired, replacing the actual silence frames with one or more frames having predetermined signal levels, or by discarding one or more of the silence frames. In this manner, both the average effective transmission bitrate and the average signal delay are reduced.

In other cases, only the information that this is a silence frame is transmitted, and the decoder itself uses a "comfort noise" generator to fill in the signal in these frames. As is known to those skilled in the art, conventional comfort noise generators provide for the insertion of an artificial noise during silent intervals of speech for approximating acoustic noise that matches the actual background noise. Once these silence frames are overlapped and added, discarded, decimated or replaced, and encoded, the above-described process repeats, beginning with extraction of a new current frame by the frame extraction module 215.

Alternatively, if the current frame is determined to be a speech frame, rather than a silence frame as described in the preceding paragraph, then in one embodiment, all of the frames in the frame buffer 240 are also identified as speech frames. At this point, the temporal compression module 230 is used to provide a time-scale modification of both the current frame and the buffered frames for temporally compressing that frames prior to encoding the frames as speech frames. As described above, temporal compression of the frames serves to decrease both the average effective transmission bitrate and the average signal delay. Once temporal compression of the frames has been completed, the temporally compressed speech frames are encoded as one or more speech frames by the encoding module 225, and included in the encoded bitstream 235.

In a related embodiment, prior to temporal encoding of the speech frames, a search of the buffered frames is first performed by a buffer search module 255 to locate the actual starting point, or onset, for the speech or utterance identified in the current frame. Any frames in the frame buffer 240 preceding the frame having the located starting point are either discarded or encoded as silence frames as described above. Further, the current frame, the frame including the located onset point, and all subsequent frames in the frame buffer 240, are then identified as speech frames, temporally compressed, encoded, and included in the encoded bitstream 235, as described above. Once these speech frames are encoded, the above-described process repeats, beginning with extraction of a new current frame by the frame extraction module 215.

3.0 Operation Overview:

The above-described program modules are employed in a speech onset detector for providing real-time detection and preservation of speech onset. The following sections provide a detailed operational discussion of exemplary methods for implementing the aforementioned program modules.

Figure 3:
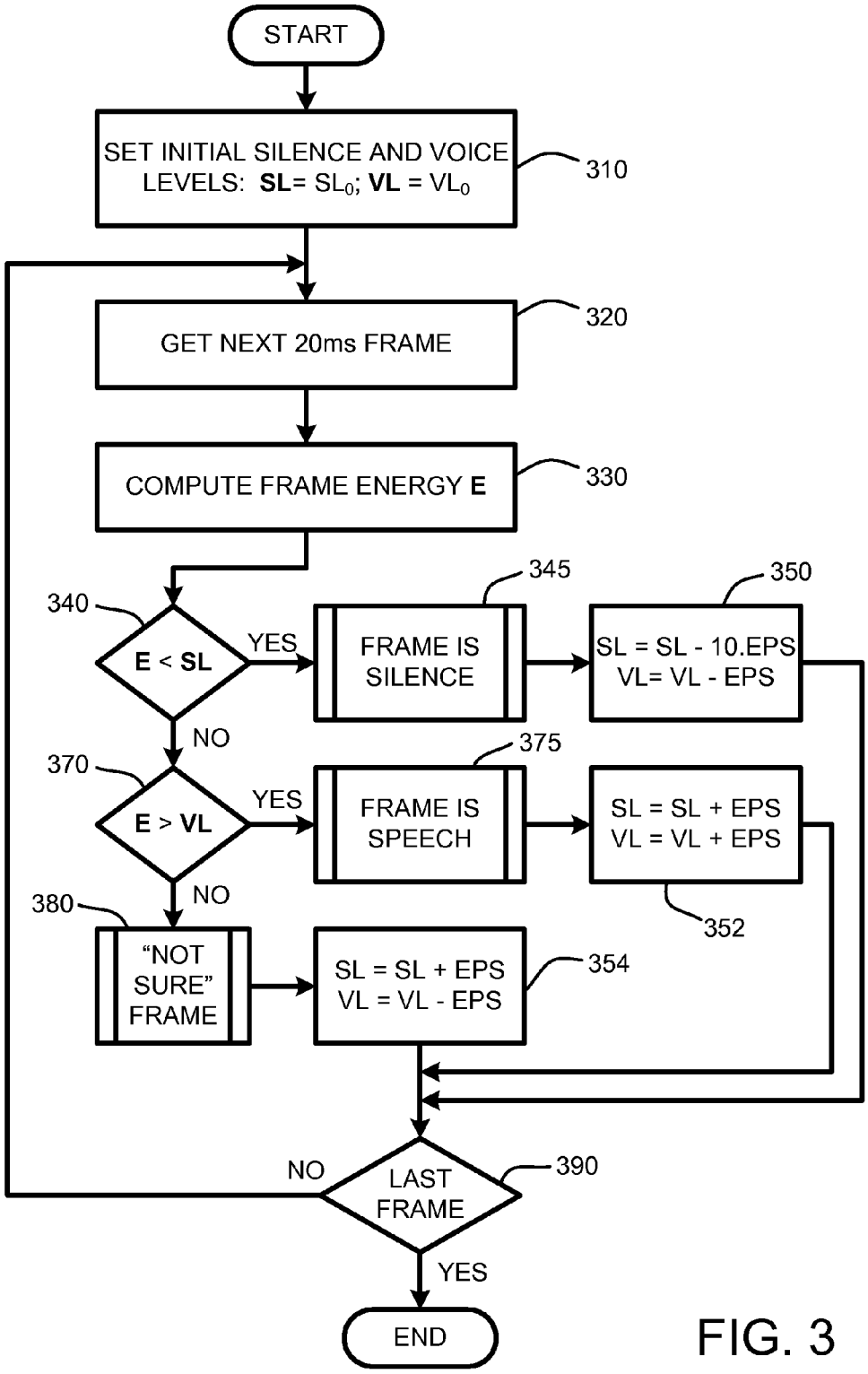
FIG. 3 illustrates an exemplary system flow diagram for a frame energy-based speech detector.
Figure 4:
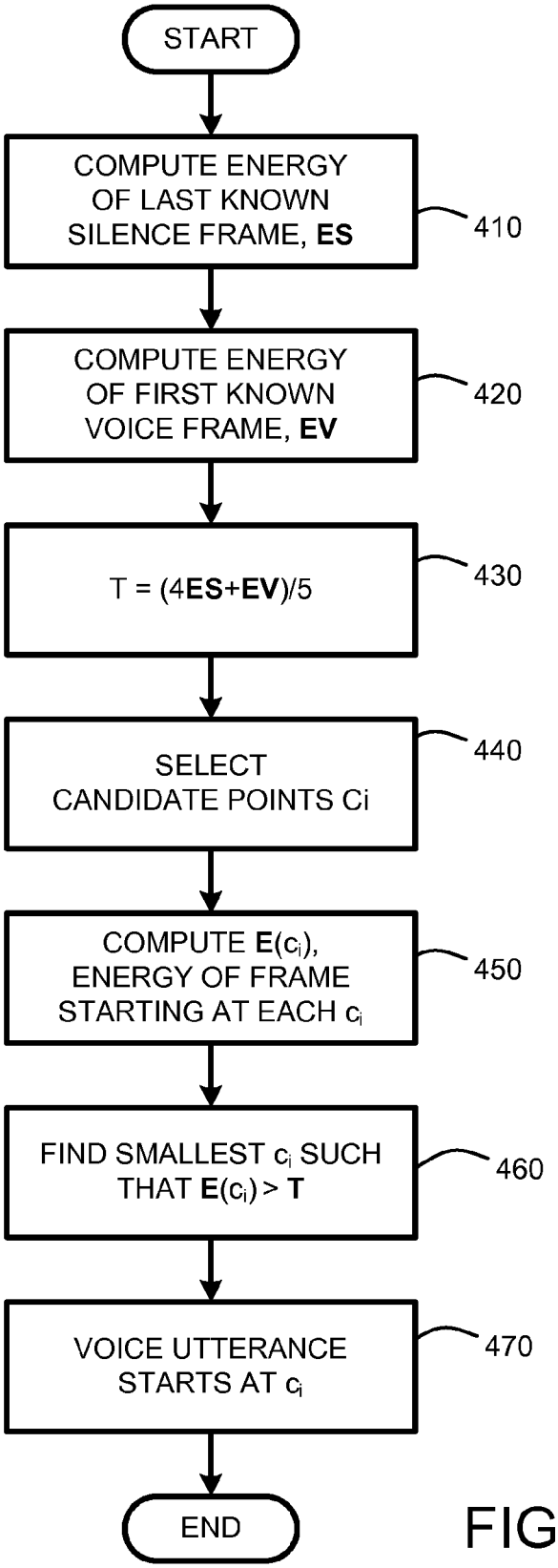
FIG. 4 illustrates an exemplary system flow diagram for identifying actual speech onset in one or more signal frames.
Figure 5:
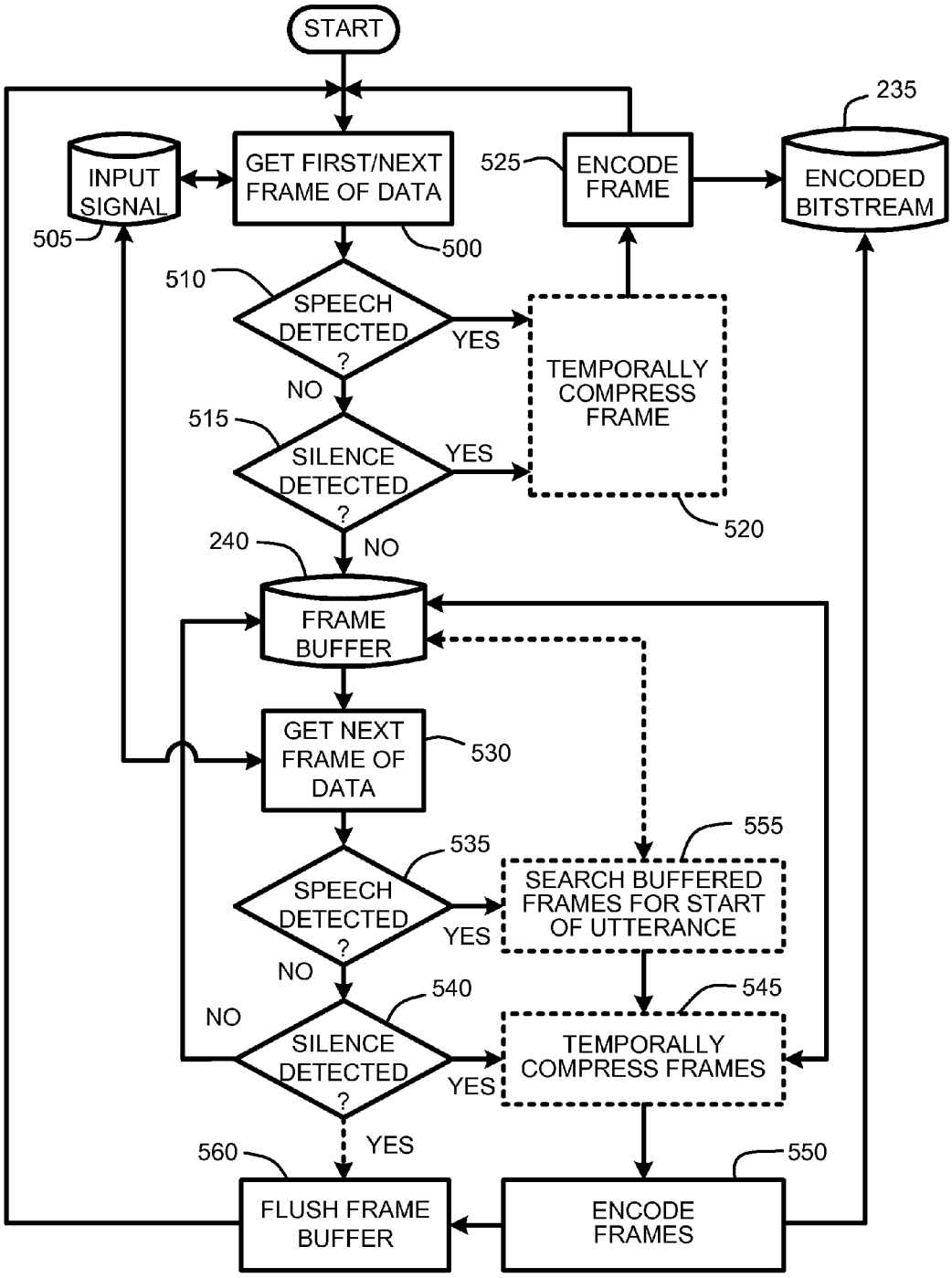
FIG. 5 illustrates an exemplary system flow diagram for real-time detection and preservation of speech onset.

3.1 Operational Elements:

As noted above, the speech onset detector provides a variable length frame buffer in combination with temporal speech compression of current and buffered speech frames for decreasing both the average effective transmission bitrate and the average signal delay. The following sections describe major functional components of the speech onset detector in the context of an exemplary system flow diagram for real-time detection and preservation of speech onset as illustrated by FIG. 3 through FIG. 5.

3.1.1 Speech Detection:

In general, the speech onset detector is capable of using any conventional speech detector designed to detect speech onset in an audio signal. As noted above, such speech detectors are well known to those skilled in the art. As described above, conventional methods for identifying speech onset in a signal typically involve a frame-based analysis of the signal, with typical frame length being on the order of about 10 ms or more. Typically, the reliability of the decision regarding whether speech exists in a particular frame or frames will increase with the frame size up to around 100 ms or so. These conventional methods are typically based on any of a number of functions, including, for example, functions of signal short-time energy, pitch detection, zero-crossing rate, spectral energy, periodicity measures, signal entropy information, etc.

A typical example of a higher complexity speech detection algorithm can be found in the 3GPP technical specification TS26.194, "AMR Wideband speech codec; Voice Activity Detector (VAD)." However, for purposes of explanation, an example of a simple detector, based only on frame energy, but which includes the "not sure" state is described below.

In particular, FIG. 3 shows a block diagram of a simple frame energy-based speech detector. First, at step 310, initial levels, $SL_0$ and $VL_0$, are selected for the silence level (SL) and voice level (VL). These initial values are either obtained experimentally, or are set to a low value (or zero) for SL and a higher value for VL. An increment step size, EPS, is also set to some appropriate level, for example 0.001 of the maximum energy level. Next, the next frame to be classified is retrieved 320. The energy E of that frame is then computed 330. The energy E is then compared 340 with the silence level SL. If the energy E is below the silence level SL, the frame is declared to be a silence frame 345, and the threshold levels SL and VL are updated 350 by decreasing VL by one step size (i.e., VL=VL−EPS), and decreasing SL by ten step sizes (i.e., SL=SL−10·EPS).

Conversely if the frame energy level E is not smaller than the silence level threshold SL, E is then compared with the Voice Level threshold VL 370. If the frame energy E is greater then VL, the frame is declared to be a speech frame 375, and the threshold levels SL and VL are updated 352 by increasing both SL and VL by one step size. Further, if the energy frame E is not greater than VL 370, then the frame is declared to be a "not sure" frame in 380, and the threshold levels SL and VL are updated 354 by increasing SL by one step size, and decreasing VL by one step size. Finally a check is made to determine whether more frames are available 390, and, if so, the steps described above (310 through 380) for frame classification are repeated.

In addition, as Illustrated by the above example in view of FIG. 3, it should be noted that the equations for updating SL and VL (350, 352, and 354) were chosen such that the voice level VL will converge to a value that is approximately equivalent to the $50^{th}$ percentile, and the silence level SL to the $10^{th}$ percentile.

3.1.2 Frame Buffer Search for Speech Onset:

As noted above, in one embodiment, buffered frames are searched to locate the actual onset point of speech that is identified in the current signal frame. For example, it may be the case that the last frame classified before the ones currently in the buffer was a silence frame, and the most recent frame in the buffer is classified as speech. The objective is then to identify as reliably as possible the exact point where the speech starts. FIG. 4 provides an example of a system flow diagram for identifying such onset points.

In particular, in one embodiment, the speech in the current frame is used to initialize the search of the buffered frames by computing the EV, the energy of the last known speech frame 410, where:

$$EV = \sum_{n=0}^{N=1} (x[A+n])^2 \quad \text{Equation 1}$$

where $I$ is the frame size and A is the starting point of the voice frame. Then, the energy of the last known silence frame ES is computed in 420 using a similar expression (and it is assumed to be smaller than EV). A threshold T is established in 430 with a value between EV and ES, for example by setting $$T=(4ES+EV)/5 \quad \text{Equation 2}$$

Then, a number (or all) samples $c_i$ in the buffer are selected 440 to be tested as possible starting points (onset points) of the speech. For each candidate point, the energy level of a number of samples equivalent to a frame is computed, starting at the candidate point. In particular, for each candidate point $c_i$, an energy $E(c_i)$ is computed 450 as by Equation 3:

$$E(c_i) = \sum_{n=0}^{N=1} (x[c_i+n])^2 \quad \text{Equation 3}$$

Then, the oldest sample $c_i$ for which the energy is above the threshold 460 is identified, i.e., the sample for which $E(c_i)>T$. Finally, that identified sample is declared to be the start of the utterance 470, i.e., the speech onset point.

Note that the simple example illustrated by FIG. 4 is provided for purposes of explanation only. Clearly, as should be appreciated by those skilled in the art, the processes described with respect to FIG. 4 are based only on a frame energy measure, and does not use zero-crossing, spectral information, or any other characteristics known to be useful in determining voice presence in a particular frame. Consequently, this information, zero-crossing, spectral information, etc., is used in alternate embodiments for creating a more robust speech onset detection system. Further, other well known methods for determining speech onset points from a particular sample of frames may be used in additional embodiments. For example, such methods include looking for the inflection point in the spectral characteristics of the signal, as well as recursive, hierarchical search methods.

3.2 System Operation:

As noted above, the program modules described in Section 2.0 with reference to FIG. 2, and in view of the more detailed description provided in Section 3.1, are employed for automatically providing real-time detection and preservation of speech onset in a signal. This process is depicted in the flow diagram of FIG. 5, which represents alternate embodiments of the speech onset detector. It should be noted that the boxes and interconnections between boxes that are represented by broken or dashed lines in each of these figures represent further alternate embodiments of the speech onset detector, and that any or all of these alternate embodiments, as described below, may be used in combination.

Referring now to FIG. 5 in combination with FIG. 2, in one embodiment, the process can be generally described as a system and method for providing real-time detection and preservation of speech onset in a signal by using a variable length frame buffer in combination with temporal compression of buffered speech frames.

In particular, as illustrated by FIG. 5, a system and method for providing real-time detection and preservation of speech onset in a signal begins by extracting a first frame of data 500 from an input signal 505 containing speech or other utterances. Once retrieved, the first frame is analyzed to determine whether speech can be detected 510 in that frame. If speech is detected 510 in that frame, i.e., the frame is a speech frame, then the frame is optionally temporally compressed 520, encoded 525, and output to the encoded bitstream 235.

If speech is not detected 510 in the first frame, then a determination is made as to whether silence is detected 515 in that frame. If silence is detected 515 in that frame, i.e., the frame is a silence frame, then the frame is either discarded, or, in one embodiment, temporally compressed 520, encoded 525, and output to the encoded bitstream 235. Note that encoding of silence frames is often different than that of speech frames, e.g., by using less bits to encode a frame. However, if that frame is not a silence frame, then it is considered to be a not-sure frame, as described above. This not-sure frame is then stored to the frame buffer 240.

The next step is to retrieve a next frame of data 530 from the input signal 505. That next frame, also referred to as the current frame, is then analyzed to determine whether it is a speech frame. If speech is detected 535 in the current frame, then both that frame, and any frames in the frame buffer 240 are identified as speech frames, temporally compressed 545, encoded 550, and included in the encoded bitstream 235.

Further, in a related embodiment, given the speech detected in the current frame as an initialization point, the frames in the frame buffer 240 are searched to determine which, if any, of those frames includes the actual onset point of the speech in the current frame. Once the actual onset point is identified in a buffered frame, all preceding frames in the frame buffer 240 are identified as silence frames, and the frame having the onset point is identified as a speech frame along with all subsequent frames in the frame buffer and the current frame.

If the analysis of the current frame indicates that it is not a speech frame, then that frame is examined to determine whether it is a silence frame. If silence is detected 540 in the current frame, then both that frame, and any frames in the frame buffer 240 are identified as silence frames. In one embodiment, all of these silence frames are simply discarded. Alternately, in a related embodiment, the silence frames are temporally compressed, either by simply decimating those frames, or discarding one or more of those frames, followed by temporal compression 545 of the frames, encoding 550 of the frames, and including the encoded frames in the encoded bitstream 235.

Further, once encoding 550 of detected speech frames or silence frames, 535 and 545, respectively, has been completed, the frame buffer is flushed 560 or emptied. The above-described steps then repeat, beginning with selection of a next frame 500 from the input signal 505.

On the other hand, if neither speech 535 nor silence 540 is detected in the current frame, then that current frame is considered to be another not-sure frame that is then added to the frame buffer 240. The above-described steps then repeat, beginning with selection of a next frame 530 from the input signal 505.

In view of the discussion provided above, it should be appreciated that the speech onset detector provides a novel system and method for using a variable length frame buffer in combination with temporal compression of signal frames for reducing or eliminating any signal delay or bitrate increase that would otherwise result from use of a signal buffer in a speech onset detection and encoding system.

The foregoing description of the invention has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the speech onset detector described herein. It is intended that the scope of the invention be limited not by this detailed description, but rather by the claims appended hereto.

What is claimed is:

1. A system for encoding speech onset in a signal, comprising:

using a computing device for continuously analyzing and encoding sequential frames of at least one digital audio signal while analysis of the sequential frames indicates that the sequential frames is of a frame type including any of a speech type signal frame and a non-speech type signal frame without buffering any of the speech type signal frames and non-speech type signal frames prior to encoding;

continuously analyzing and buffering sequential frames of the at least one digital audio signal to a variable length frame buffer while analysis of each sequential frame is unable to determine whether each sequential frame is of a frame type including any of the speech type signal frame and the non-speech type signal frame, such that only frames having an undeterminable type are buffered;

automatically designating at least one of the buffered sequential frames as having the same type as a current sequential frame when analysis of the current sequential frame indicates that it is of a frame type including any of the speech type signal frame and the non-speech type signal frame;

encoding the buffered sequential frames; and wherein encoding any of the sequential frames and the buffered sequential frames comprises encoding those frames using a frame type-specific encoder having a frame size corresponding to the type of each frame.

2. The system of claim 1 further comprising temporally compressing at least one of the buffered sequential frames prior to encoding those frames.

3. The system of claim 2 further comprising searching the buffered sequential frames prior to temporally compressing those frames for identifying a speech onset point within one of the buffered sequential frames when the current sequential frame is a speech type signal frame.

4. The system of claim 3 wherein buffered sequential frames preceding the buffered sequential frame having the speech onset point are discarded prior to temporally compressing the buffered sequential frames.

5. The system of claim 4 wherein initial samples in the frame having the speech onset point which precede the speech onset point are discarded prior to temporally compressing the buffered sequential frames.

6. The system of claim 5, wherein a frame boundary of the buffered sequential frame having the speech onset point is reset to coincide with the identified speech onset point.

7. The system of claim 1 wherein the at least one digital audio signal comprises a digital communications signal.

8. The system of claim 1 further comprising flushing the variable length frame buffer following encoding of the buffered sequential frames.

9. A computer-implemented process for encoding at least one frame of a digital audio signal, comprising:

using a computing device for encoding a current frame of the audio signal when it is determined that the current frame of the audio signal includes any of speech and non-speech, without buffering any frames that are determined to include any of speech and non-speech;

buffering the current frame of the audio signal in a variable length frame buffer when it can not be determined whether the current frame of the audio signal includes any of speech and non-speech;

sequentially analyzing and buffering subsequent frames of the audio signal until analysis of the subsequent frames identifies a frame including any of speech and non-speech; and encoding the buffered frames and the identified subsequent frame using a frame type-specific encoder having a frame size corresponding to the type of the identified subsequent frame.

10. The computer-implemented process of claim 9 further comprising searching the buffered subsequent frames in the variable length frame buffer for identifying a speech onset point within one of the buffered sequential frames when analysis of the subsequent frames identifies a frame including speech.

11. The computer-implemented process of claim 10 wherein buffered sequential frames preceding the buffered frame having the speech onset point are identified as silence frames.

12. The computer implemented process of claim 11 wherein at least one of the silence frames are discarded from the variable length frame buffer prior to temporally compressing the buffered sequential frames.

13. The computer-implemented process of claim 9 further comprising temporally compressing each buffered frame by applying a pitch preserving temporal compression to the buffered frames.

14. The computer-implemented process of claim 9 further comprising temporally compressing each buffered frame by decimating at least one of the buffered frames.

15. A method for capturing speech onset in a digital audio signal, comprising using a computing system for:

sequentially analyzing and encoding chronological frames of a digital audio signal when an analysis of the chronological frames identifies the presence of any of speech and non-speech in the frames of the digital audio signal, without buffering any frames that include a presence of any of speech and non-speech;

buffering each chronological frame of the digital audio signal to a variable length frame buffer whenever the analysis of the chronological frames is unable to identify a presence of any of speech and non-speech in those frames;

designating at least one of the buffered chronological frames preceding a current chronological frame of the digital audio signal as having a same content type as the current chronological frame when the analysis the current chronological frame identifies the presence of any of speech and non-speech in the current chronological frame; and encoding the current chronological frame and the at least one designated using a frame type-specific encoder having a frame size corresponding to the type of each frame.

16. The method of claim 15 further comprising temporally compressing at least one of the buffered frames when the analysis of the chronological frames identifies the presence of speech in the digital signal prior to encoding the current chronological frame and at least one of the buffered chronological frames.

17. The method of 16 further comprising searching the buffered chronological frames in the variable length frame buffer, prior to temporally compressing at least one of the buffered chronological frames, for identifying a speech onset point within one of the buffered chronological frames, and wherein said search is initialized using speech identified in the current chronological frame.

18. The method of claim 17 wherein buffered chronological frames preceding the buffered chronological frame having the speech onset point are identified as non-speech frames.

19. The method of claim 17 wherein samples of the at least one digital audio signal within the buffered chronological frame having the speech onset point are identified as non-speech samples.

20. The method of claim 15 wherein the at least one digital audio signal comprises a digital communications signal in a real-time communications device.

* * * * *